US006035982A

United States Patent [19]

Wei-Chih

[11] Patent Number: 6,035,982

[45] Date of Patent: Mar. 14, 2000

[54] PROTECTION STRUCTURE OF SOFT CUSHION USING ON THE SIDE CORNER OF LUGGAGE

[75] Inventor: Chen Wei-Chih, Taichung Hsien, Taiwan

[73] Assignee: Yung Ta Hardware & Plastics Co., Ltd., Chang Hua Hsien, Taiwan

[21] Appl. No.: 09/210,697

[22] Filed: Dec. 14, 1998

[30] Foreign Application Priority Data

Apr. 23, 1998 [CN] China ..... 87206216

[51] Int. Cl.[7] ..... A45C 13/26

[52] U.S. Cl. ..... 190/37; 190/126; 190/127

[58] Field of Search ..... 190/126, 127, 190/37

[56] References Cited

U.S. PATENT DOCUMENTS

| | | | |
|---|---|---|---|
| 2,263,467 | 11/1941 | Medoff | 190/126 |
| 2,438,591 | 3/1948 | Wheary, Jr. | 190/37 |
| 2,487,951 | 11/1949 | Stein | 190/126 |
| 2,510,643 | 6/1950 | Long | 190/126 |
| 2,847,100 | 8/1958 | Hotchner | 190/37 |
| 4,383,142 | 5/1983 | Kaneko | 190/126 |
| 4,784,248 | 11/1988 | Workman | 190/126 |
| 4,932,506 | 6/1990 | Kim | 190/126 X |
| 5,289,906 | 3/1994 | Guidi | 190/107 |

*Primary Examiner*—Gary E. Elkins
*Assistant Examiner*—Tri M. Mai
*Attorney, Agent, or Firm*—Harrison & Egbert

[57] ABSTRACT

A side corner protection structure on the luggage is constructed of a soft rubber cushion strip which is provided at external an side corner of the steel cable of the luggage, and a prevent cushion plate is provided at the corner of luggage. The soft rubber cushion strip is of hollow tube construction which its inner part covers the steel cable of external, side luggage. At the surrounding of tube is formed a plurality of convex rings, and at the both sides edge of the tube is extended per each a fix piece which is sewed to each other for fixing the soft rubber cushion strip. The fix piece is formed a plurality of shrill teeth which its acute angle are not over 45°, and the distance between each two shrill teeth is around 0.2~0.3 cm. In addition, the surface of prevent cushion plate protrudes with a plurality of squares and in order to match with the corner of luggage, the prevent cushion plate is therefore formed of arc shape for protecting the side edge of luggage from impacts, rubbing or wear-and-tear.

1 Claim, 4 Drawing Sheets

PROTECTION STRUCTURE OF SOFT CUSHION USING ON THE SIDE CORNER OF LUGGAGE

FIELD OF THE INVENTION

The present invention relates generally to a protection structure on the luggage, and more particularly to a protection structure of a soft cushion using on the side corner of luggage.

BACKGROUND OF THE INVENTION

The main body of the luggage is commonly constructed of a cloth or a soft rubber material. In order to enable the body of luggage to endure, it is therefore provided with a steel cable which is covered outside by a rubber membrane around the external frame of the body of the luggage.

Such structure is defective in design since the appearance of the luggage's body is easy damaged by impacts, rubbing, or general wear-and-tear. Besides, since the side steel cable of the body is protruded and, the exterior of the membrane can be broken off. All of these shortcomings will affect the pleasing appearance of the luggage to the eye.

SUMMARY OF THE INVENTION

The primary objective of the present invention is therefore to provide a side corner protection structure on the luggage which is specially constructed of a soft rubber cushion strip and a prevent cushion plate, so as to protect the side edge of luggage from impacts, rubbings, or wear-and-tear.

In the present invention a side corner protection structure on the luggage has side steel cable and corner surface of the luggage which is constructed of a soft rubber cushion strip and a prevent cushion plate. The soft rubber cushion strip is extended with a fix piece which is formed with a plurality of shrill teeth, and the prevent cushion plate is provided with a plurality of squares on the surface. If the soft rubber cushion strip is bent in installing on the steel cable, the fix piece will not cause protruding. Moreover, the plurality of squares on the prevent cushion plate can protect the appearance of the luggage.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
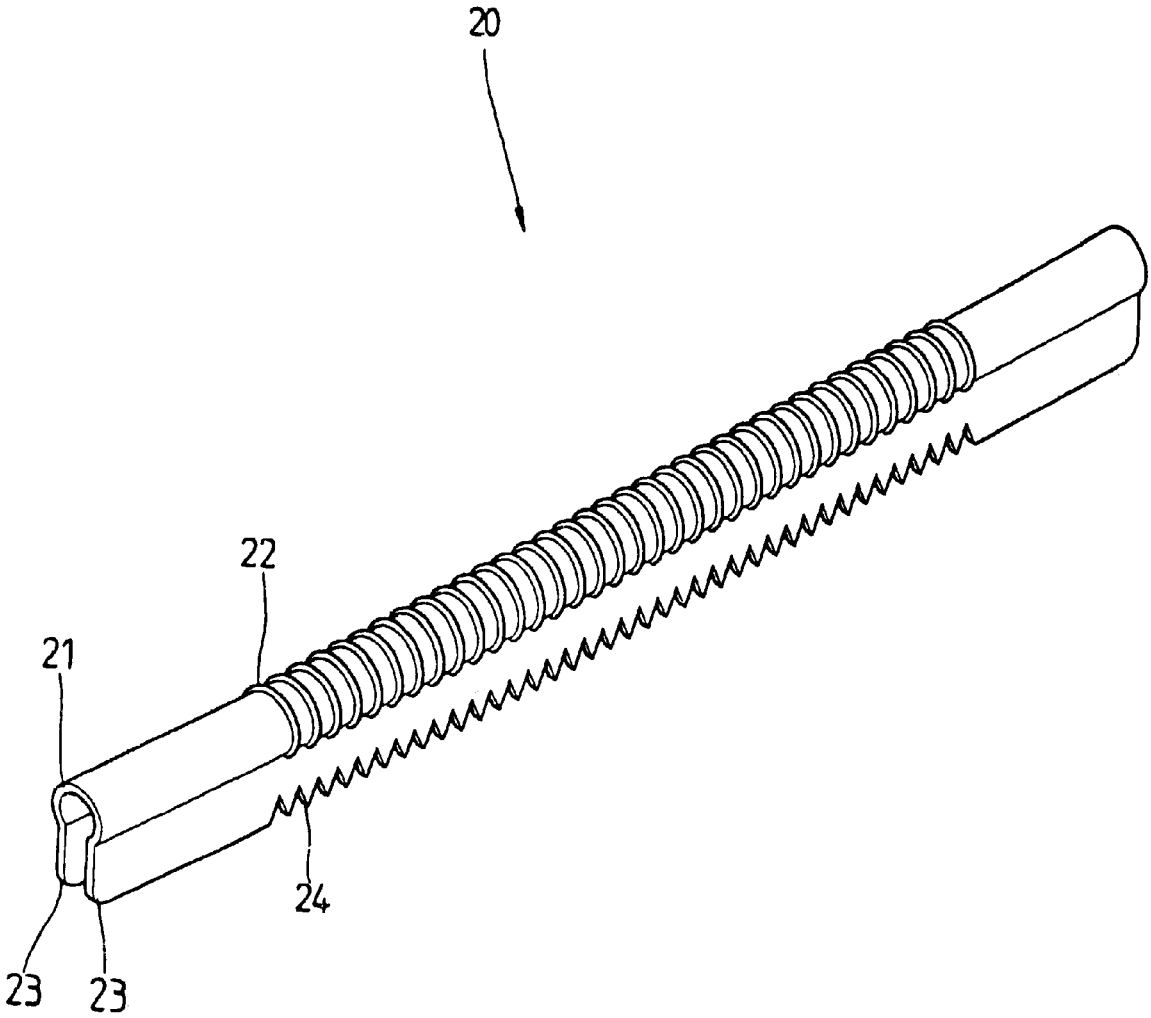
FIG. 1 shows a perspective view of a soft rubber cushion strip of the present invention.
Figure 2:
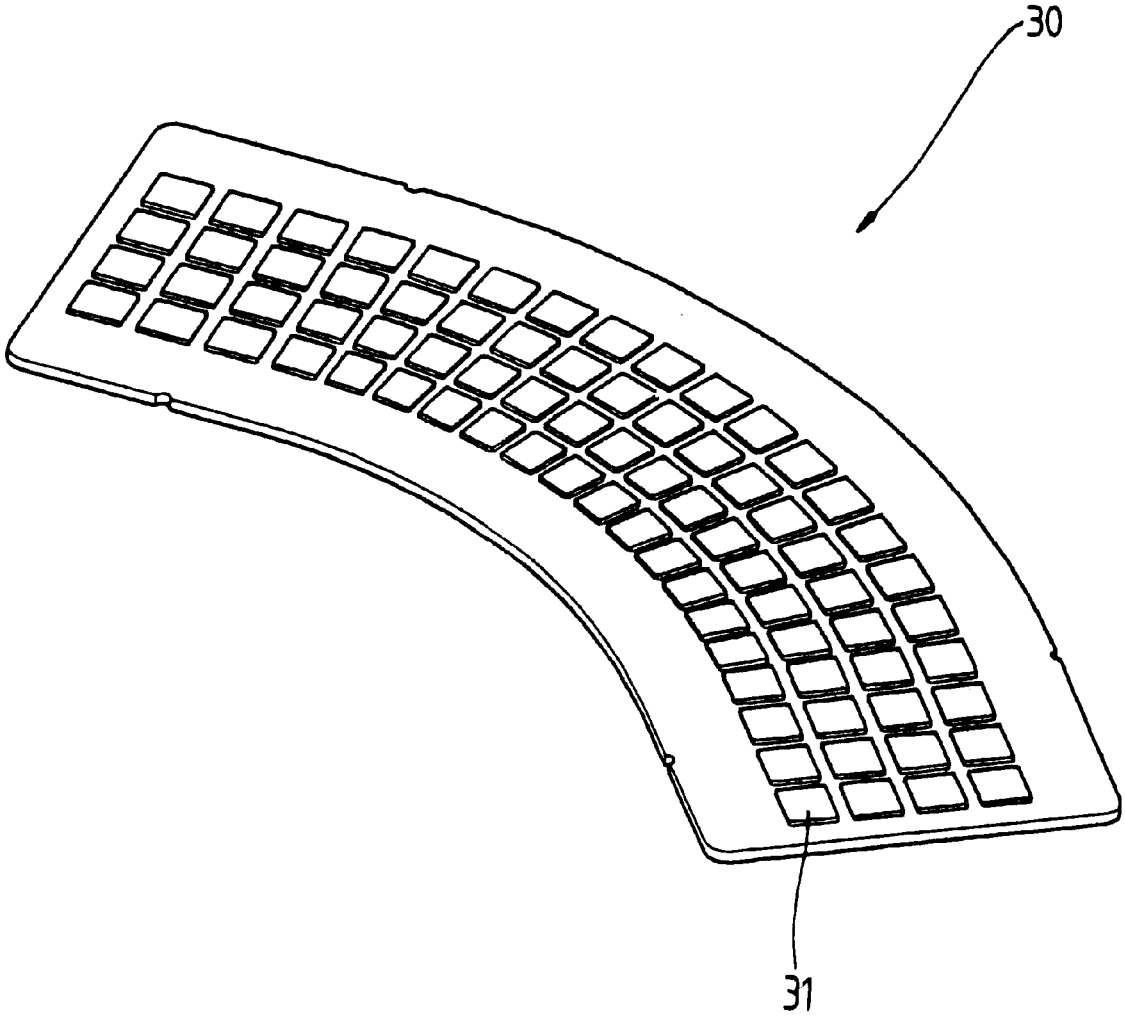
FIG. 2 shows a perspective view of a prevent cushion plate of the present invention.
Figure 3:
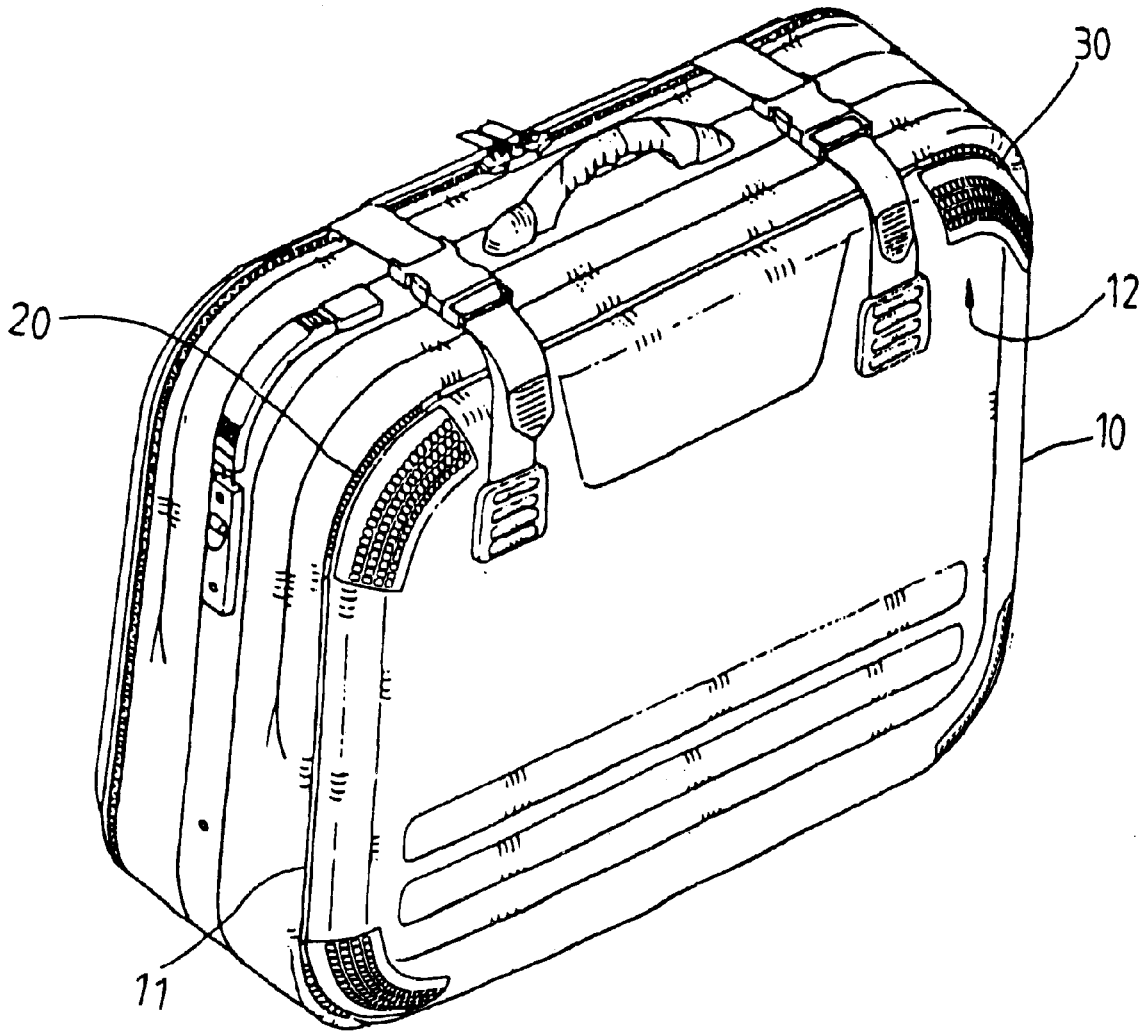
FIG. 3 shows a perspective view of the present invention being used on the luggage.

As shown in FIGS. 1–3, a side corner protection structure on the luggage is constructed of a soft rubber cushion strip 20 which is provided at an external side corner of steel cable 11 of the luggage 10, and a wear-preventing cushion plate 30 is provided at the corner 12 of luggage.

The soft rubber cushion strip 20 is of hollow tube 21 construction in which its inner part covers the steel cable 11 of external side corner of luggage 10. At the exterior of tube

21 is formed a plurality of convex rings 22. Fixing pieces 23 extend outwardly from the tube 21. The fixing pieces 23 are sewed to each other for fixing the soft rubber cushion strip 20 onto the steel cable 11. Each of the fixing pieces 23 has a plurality of sharp teeth 24 formed on an edge thereof. Each of the plurality of sharp teeth 24 has a pointed end having an angle of not more than 45°. A distance between the pointed ends of adjacent pairs of teeth is between 0.2 and 0.3 centimeters.

The surface of wear-preventing cushion plate 30 protrudes a plurality of squares 31. In order to match with the corner 12 of luggage 10. The cushion plate 30 is of an arc-shaped configuration.

As shown in FIG. 3 matching with the FIGS. 1 and 2, the steel cable 11 of at the corners of luggage 10 is arc-shaped and protrudes outwardly therefrom. The exterior of steel cable 11 is covered by the present invention of soft rubber cushion strip 20, so that the side corner of luggage 10 is protected from rubbing. In addition, providing at the corner 12 of the luggage's surface is the wear-preventing cushion plate 30 of the present invention to prevent the side corner of luggage 10 from wearing. Moreover, the exterior of soft rubber cushion strip 20 is provided with a plurality of convex rings 22 and the exterior of wear-preventing cushion plate 30 is provided with a plurality of squares 31, so that the side of luggage 10 is prevented from impacts and wear, and the useful life of the soft rubber cushion strip 20 and wear-preventing cushion plate 30 are still maintained.

Figure 4:
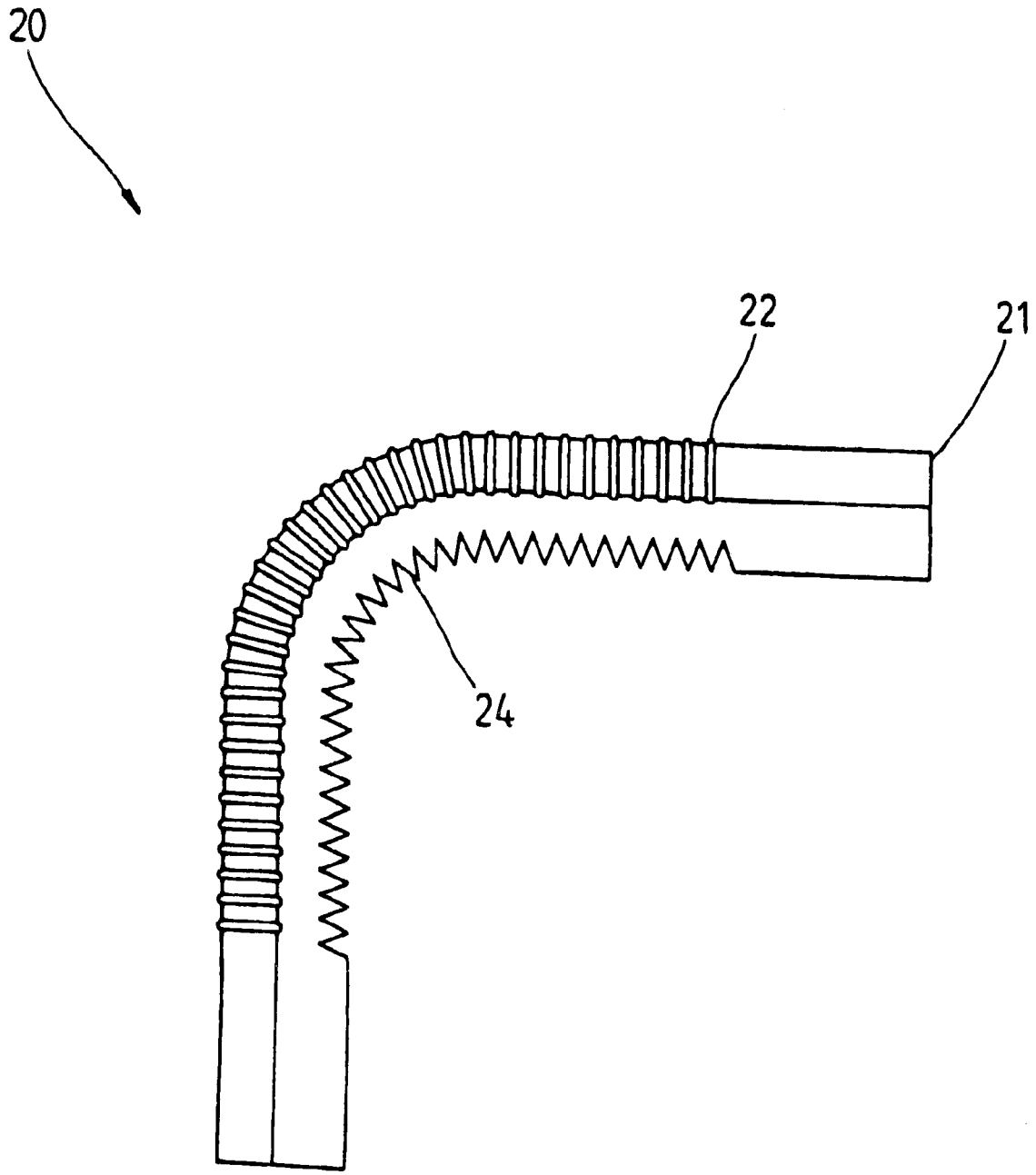
FIG. 4 shows a schematic view of a soft rubber cushion strip of the present invention in bending.

As shown in FIG. 4, while the soft rubber cushion strip 20 is bending in operation, the plurality of sharp teeth 24 of fixing piece 23 takes advantage of its angle and distance to close toward each other. Therefore, the edge of fixing piece 23 can avoid bending or protruding.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claim.

I claim:

1. A protective structure comprising:

a luggage article having a steel cable extending therearound;

a plurality of rubber cushion strips affixed onto said steel cable, each of said plurality of rubber cushion strips being of a hollow tube construction, an interior of said hollow tube construction receiving said steel cable, each of said plurality of rubber cushion strips having a plurality of convex rings extending exteriorly therearound, each of said plurality of rubber cushion strips having fixing piece extending outwardly therefrom, said fixing pieces being sewed together so as to secure said steel cable within said interior of said hollow tube construction, each of said fixing pieces having a plurality of sharp teeth formed on an edge thereof, each of said plurality of sharp teeth having a pointed end having an angle of not more than 45°, a distance between the pointed ends of adjacent pairs of said plurality of sharp teeth being between 0.2 and 0.3 centimeters; and a plurality of cushion plates affixed adjacent to respective corners of said luggage article on an exterior surface of said luggage article, each of said plurality of cushion plates having a plurality of square members protruding outwardly from a surface thereof, each of said plurality of cushion plates being of an arc-shaped configuration.

* * * * *